US006588023B1

(12) United States Patent
Wright

(10) Patent No.: US 6,588,023 B1
(45) Date of Patent: Jul. 8, 2003

(54) RIFLE RECOIL PAD

(76) Inventor: Randol D Wright, 2412 Axtell St., Clovis, NM (US) 88101

( * ) Notice: Subject to any disclaimer, the term of this patent is extended or adjusted under 35 U.S.C. 154(b) by 0 days.

(21) Appl. No.: 10/154,242

(22) Filed: May 22, 2002

(51) Int. Cl.[7] ..... A41D 27/26
(52) U.S. Cl. ..... 2/459; 2/94; 42/74
(58) Field of Search ..... 2/459, 463, 94, 2/2, 2.5, 44, 45; 42/74

(56) References Cited

U.S. PATENT DOCUMENTS

| | | | | | |
|---|---|---|---|---|---|
| 1,587,946 | A | | 6/1926 | Gibson | |
| 1,650,491 | A | * | 11/1927 | Calvert | |
| 2,831,193 | A | | 4/1958 | Terry | |
| 2,955,293 | A | | 10/1960 | Peterson | |
| 3,257,666 | A | | 6/1966 | Hoffman | |
| 3,504,377 | A | * | 4/1970 | Biggs, Jr. et al. | |
| 3,676,387 | A | * | 7/1972 | Lindlof | 260/33.4 |
| 4,344,229 | A | * | 8/1982 | Johnson | 83/830 |
| 4,493,115 | A | * | 1/1985 | Maier et al. | 2/95 |
| 4,514,862 | A | * | 5/1985 | A'Costa | 2/268 |
| 4,547,905 | A | * | 10/1985 | LaPorta, Jr. | 2/268 |
| 4,610,034 | A | | 9/1986 | Johnson | |
| 5,008,960 | A | | 4/1991 | Hemming | |
| 5,101,511 | A | * | 4/1992 | Elverskog | 2/2.5 |
| D340,124 | S | | 10/1993 | Paxton | |
| 5,943,700 | A | * | 8/1999 | Hammer et al. | 2/94 |
| 5,955,159 | A | * | 9/1999 | Allen et al. | 523/300 |
| 6,175,967 | B1 | * | 1/2001 | Donzis | 2/413 |
| 6,301,713 | B1 | | 10/2001 | Aceves et al. | |

FOREIGN PATENT DOCUMENTS

| | | | | |
|---|---|---|---|---|
| CH | 587 467 | * | 4/1977 | 2/2.5 |
| DE | 34 33 005 A1 | * | 3/1985 | 2/463 |
| GB | 989 970 | * | 4/1965 | 2/463 |
| GB | 1 268 431 | * | 3/1972 | |
| JP | 5-103853 | * | 5/1993 | |

* cited by examiner

*Primary Examiner*—Stephen M. Johnson
(74) *Attorney, Agent, or Firm*—Antony P. Ng; Bracewell & Patterson LLP

(57) ABSTRACT

A flexible lightweight rifle recoil pad is disclosed. The rifle recoil pad includes a flexible yoke, an energy-absorbing cushion, and a counter-weight. The flexible yoke, which includes a first end section and a second end section, is sized to fit over a shoulder of a user such that the yoke extends over the top of the shoulder with the first end section positioned on the front of the user's shoulder and the second end section positioned on the rear of the user's shoulder. The energy-absorbing cushion is positioned over the yoke adjacent the first end section. The counter-weight is positioned over the yoke adjacent the second end section.

13 Claims, 2 Drawing Sheets

RIFLE RECOIL PAD

BACKGROUND OF THE INVENTION

1. Technical Field

The present invention relates to shoulder protection devices in general, and in particular to a shoulder protection device suited to absorb impact forces directed to the shoulder area of a user. Still more particularly, the present invention relates to a rifle recoil pad suited to absorb impact forces directed to the shoulder area of a user during the discharge from a shoulder-supported firearm.

2. Description of the Related Art

Repeated use of shoulder-supported firearms, such as shotguns and rifles, can be distressful and often painful for a marksman because of the unavoidable recoil impacts directed to the shoulder area of the marksman. Thus, it is often desirable for a marksman to use some sort of protective padding, such as a recoil pad, to reduce the recoil impacts from a shoulder-supported firearm on the shoulder area. With a recoil pad, a marksman should be able to shoot the shoulder-supported firearm with more comfort.

There are many types of recoil pads intended to reduce the level of recoil impacts directed to the shoulder area. Each type of recoil pad includes a different energy absorbing material that offers a user some means of protection against recoil impacts. The effectiveness of recoil pads typically depends upon the type of absorbing material utilized. Absorbing materials that have been used in recoil pads include felt, hair, leather, hard rubber, and foamed plastic. Firm materials such as leather or hard rubber do not deform very quickly when subjected to a rapidly moving recoil impact. Hence, such materials typically act more like a hard surface, which stop the recoil impact very quickly but also deliver substantial shock onto the shoulder. While foam plastic offers some improvement over the above-mentioned firm materials, foam plastic also exhibits the same "bottoming out" behavior eventually. Although the "bottoming out" behavior can be reduced by increasing the thickness of foam plastic, larger pad thickness is generally undesirable in terms of its bulkiness. Consequently, it would be desirable to provide an improved recoil pad.

SUMMARY OF THE INVENTION

In accordance with a preferred embodiment of the present invention, a flexible lightweight rifle recoil pad includes a flexible yoke, an energy-absorbing cushion, and a counter-weight. The flexible yoke, which includes a first end section and a second end section, is sized to fit over a shoulder of a user such that the yoke extends over the top of the shoulder with the first end section positioned on the front of the user's shoulder and the second end section positioned on the rear of the user's shoulder. The energy-absorbing cushion is positioned over the yoke adjacent the first end section. The counter-weight is positioned over the yoke adjacent the second end section.

All objects, features, and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

Figure 1A:
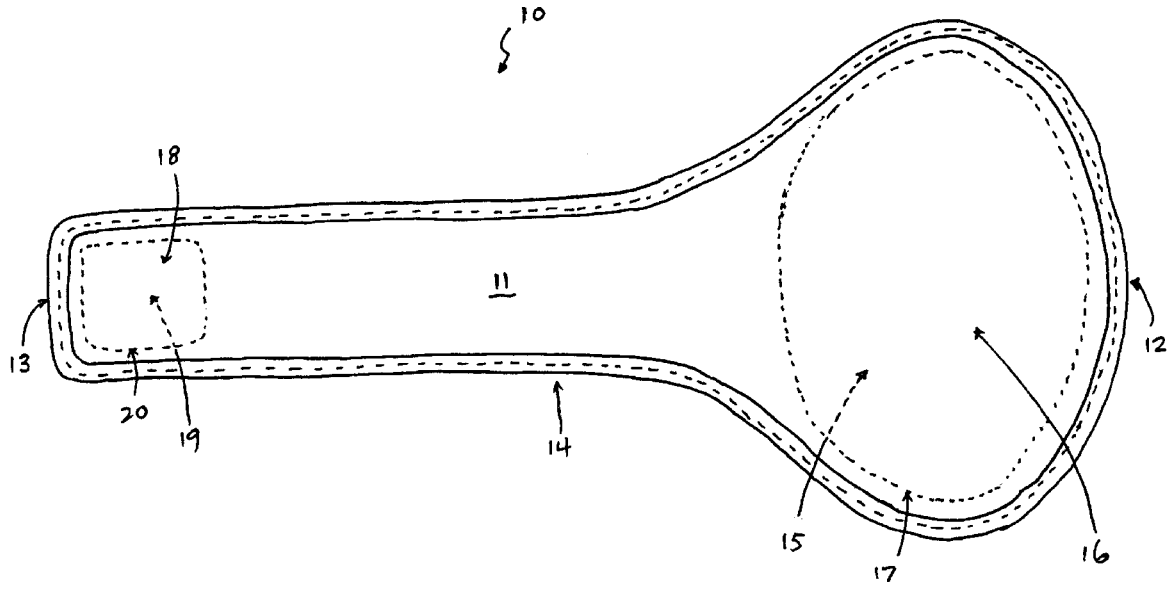
FIG. 1*a* is a top view of a rifle recoil pad, in accordance with a preferred embodiment of the invention.
Figure 1B:
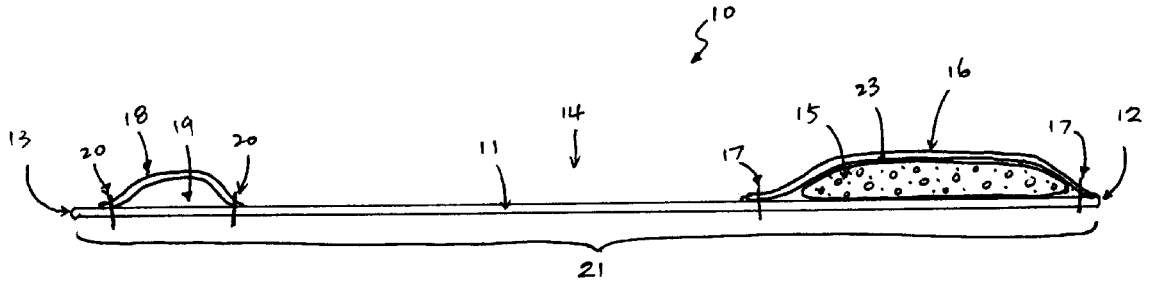
FIG. 1*b* is a cross-sectional view of a rifle recoil pad, in accordance with a preferred embodiment of the invention.

Referring now to the drawings and in particular to FIGS. 1*a* and 1*b*, there are depicted a top view and a cross-sectional view, respectively, of a rifle recoil pad, in accordance with a preferred embodiment of the invention. As shown, a rifle recoil pad 10 includes a yoke 11, which is provided with a first end section 12, a second end section 13, and a mid-section 14 positioned between first and second end sections 12, 13. First end section 12 has a generally elliptical shape, and second end section 13 has a generally rectangular shape that is tapered from first end section 12 via mid-section 14. However, first end section 12 and second end section 13 can be of different shapes.

A flexible, resilient and energy-absorbing cushion 15 is contained within a pouch 16 positioned adjacent first end section 12 of yoke 11. Cushion 15 is preferably contained in an enclosure 23. Cushion 15 and enclosure 23 are held in position within pouch 16 by means of stitching 17. Stitching 17 is positioned on pouch 16 such that the contour of stitching 17 on pouch 16 conforms to the shape of cushion 15. Preferably, stitching 17 is positioned approximately ⅛ of an inch beyond the perimeter of cushion 15. The thickness of cushion 15 is preferably in the range of one-quarter to one-half inch. In view of the thickness of cushion 15, the location of stitching 17 insures that pouch 16 cooperates with yoke 11 to form an envelope having an interior volume less than the rest volume of cushion 15. This means that pouch 16 cooperates with yoke 11 to compress cushion 15, even prior to the time the stock of a shoulder-support firearm is positioned against pouch 16. Cushion 15 is also shaped to be large enough to cover the area of a user's shoulder that will serve to support the stock of a shoulder-support firearm without being unduly cumbersome. All or part of a back surface 21 of rifle recoil pad 10 is a textured surface that provides a high coefficient of friction between rifle recoil pad 10 and the user's shoulder. Textured back surface 21 provides excellent frictional engagement between rifle recoil pad 10 and the shoulder of a user such that rifle recoil pad 10 can remain in place on the user's shoulder.

FIG. 1*b* shows the manner in which cushion 15 is confined between pouch 16 and a portion of yoke 11. It should be noted that cushion 15 substantially fills the interior volume defined between pouch 16 and yoke 11.

Preferably, cushion 15 is formed of a material having a high "Loss Factor." The term "Loss Factor" as used herein is defined at page 439 of Leo L. Beranek, Noise and Vibration Control, McGraw Hill, 1971. Preferably, cushion 15 is formed by a stable elastomeric block copolymer gel similar to the gel described in U.S. Pat. No. 3,676,387 to Lindlof (which is incorporated herein by reference), or the gel described in Example No. 3 of British Patent No. GB 1,268,431 (which is incorporated herein by reference), with the ratio of oil to block copolymer in the range of 4:1 to 10:1. Such gel is commercially available from Minnesota Mining and Manufacturing (3M) Company, St. Paul, Minn. The gel should has a Loss Factor of not less than 0.5 at 100 Hz, and a Loss Factor of not less than 1.0 at 10 Hz, and a Dynamic Young's Modulus of $1.2\times10^7$ newtons/meter$^2$. Yoke 11 may be formed of a fabric such as 60-40 Raymar.

A weight 19 is contained within a pouch 18 positioned adjacent second end section 13 of yoke 11. Weight 19 is held in position within pouch 18 by means of stitching 20. Stitching 20 is positioned on pouch 18 such that the contour of stitching 20 on pouch 18 conforms to the shape of weight 19. Preferably, stitching 20 is positioned approximately ⅛ of an inch beyond the perimeter of weight 19. Weight 19 can be made of any material and of any shape that is capable providing a counterweight to cushion 15. For example, weight 19 can be made of a solid piece of lead or multiple lead balls.

Although cushion 15 and weight 19 are shown to be confined within pouch 16 and pouch 18, respectively, via stitches, it is understood by those skilled in the art that pouches 16 and 18 can be also made with an opening such as cushion 15 and weight 19 can be removed or inserted by a user via the openings.

Figure 2A:
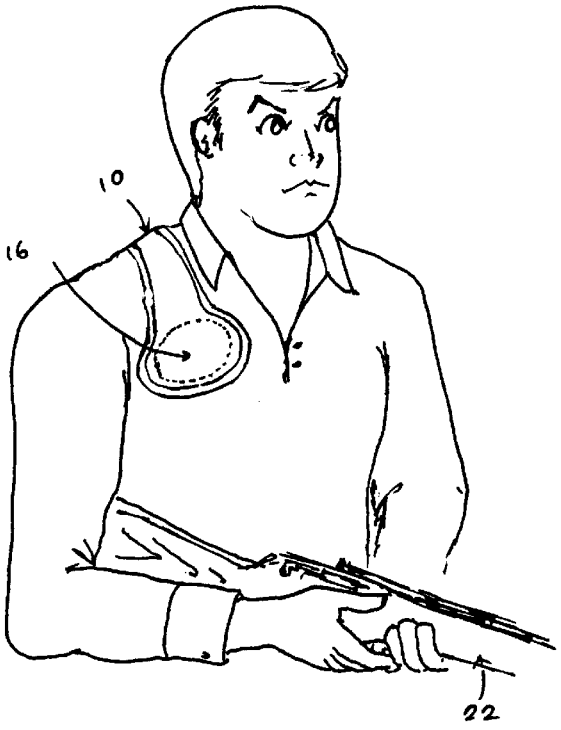
FIGS. 2*a*–2*b* are pictorial illustrations of a rifle recoil pad, as it appears when worn by a user.
Figure 2B:
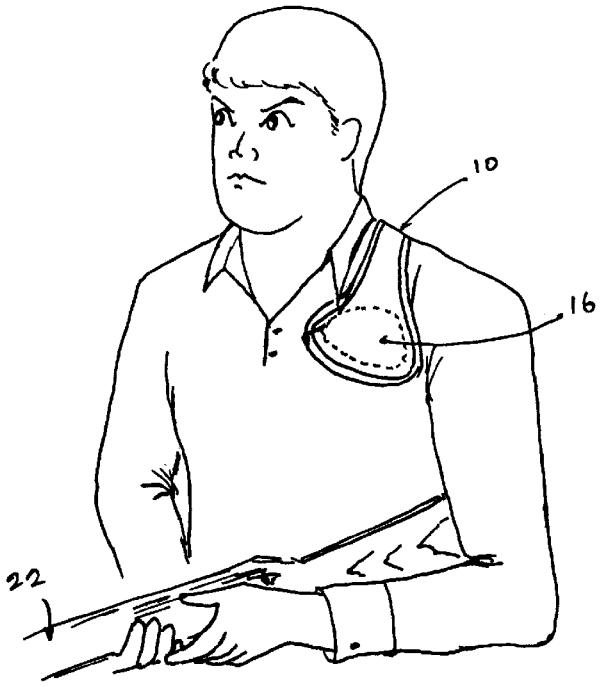

Referring now to FIGS. 2*a* and 2*b*, there are depicted pictorial diagrams of rifle recoil pad 10 as being worn by a user. As shown, yoke 11 extends from the front to the back of the user's shoulder, passing over the top of the user's shoulder. First end section 12 lies over the user's shoulder pocket area, and second end section 12 lies over the user's shoulder blade area. During use, the user holds a shoulder-support firearm, such as a high-caliber rifle 22, with the stock of the shoulder-support firearm resting directly on pouch 16. When the shoulder-support firearm is fired, recoil is passed from the stock of the shoulder-support firearm via pouch 16 and cushion 15 to the user's shoulder. However, because of the shock absorbing characteristics of cushion 15 as confined in the envelope defined by pouch 16 and yoke 11, recoil impact per unit area applied to the user's shoulder is drastically reduced.

Because of the symmetrical shape of pouch 16 and cushion 15, rifle recoil pad 10 can be used by either right-handed or left-handed users. A right-handed user may place rifle recoil pad 10 on his/her right shoulder, as shown in FIG. 2*a*. Similarly, a left-handed user may place rifle recoil pad 10 on his/her left shoulder, as depicted in FIG. 2*b*.

The shock absorbing characteristics of cushion 15 contribute to the effectiveness of the gel. In addition, the manner in which cushion 15 is confined within the envelope to produce a confined pad system significantly enhances the effectiveness of rifle recoil pad 10, because it ensures that shocks applied to cushion 15 by the stock of a shoulder-support firearm is spread to adjacent portions of cushion 15. Thus, pouch 16 cooperates with cushion 15 to provide a particularly effective recoil protection device.

As has been described, the present invention provides an improved rifle recoil pad for the protection of a user's shoulder against recoil impacts from the stock of a shoulder-support rifle. Other materials having suitable physical characteristics may be substituted for the above-described shock-absorbing gel. For example, filled or plasticized or polymerized cellulose derivatives and filled or plasticized petroleum derivatives with Loss Factor as low as 0.1 can be used as shock-absorbing gel. Furthermore, the thickness of the gel may be adjusted to provide the degree of protection needed for any particular application.

While the invention has been particularly shown and described with reference to a preferred embodiment, it will be understood by those skilled in the art that various changes in form and detail may be made therein without departing from the spirit and scope of the invention.

What is claimed is:

1. A rifle recoil pad, comprising:

a flexible yoke having a first end section and a second end section, said yoke sized to fit over a shoulder of a user such that said yoke extends over the top of said shoulder with the first end section positioned on the front of said shoulder and said second end section positioned on the rear of said shoulder;

an energy-absorbing cushion positioned over said yoke adjacent said first end section, wherein said cushion is a copolymer gel capable of absorbing and dissipating recoil forces generated during the discharge of a shoulder-supported firearm, wherein said copolymer gel has a Loss Factor of not less than 0.5 at 100 Hz and a Loss Factor of not less than 1.0 at 10 Hz; and a counter-weight positioned over said yoke adjacent said second end section.

2. The rifle recoil pad of claim 1, wherein said yoke includes a textured back surface.

3. The rifle recoil pad of claim 1, wherein said yoke is formed of a fabric.

4. The rifle recoil pad of claim 1, wherein said cushion is symmetrical in shape.

5. The rifle recoil pad of claim 1, wherein said cushion is removable from said yoke.

6. The rifle recoil pad of claim 1, wherein said counter-weight is lead.

7. The rifle recoil pad of claim 1, wherein said counter-weight is removable from said yoke.

8. The rifle recoil pad of claim 1, wherein said yoke includes a textured back surface.

9. The rifle recoil pad of claim 1, wherein said yoke is formed of a fabric.

10. The rifle recoil pad of claim 1, wherein said cushion is symmetrical in shape.

11. The rifle recoil pad of claim 1, wherein said cushion is removable from said yoke.

12. The rifle recoil pad of claim 1, wherein said counter-weight is lead.

13. The rifle recoil pad of claim 1, wherein said counter-weight is removable from said yoke.

* * * * *